US005086961A

United States Patent [19]

Angel et al.

[11] Patent Number: 5,086,961

[45] Date of Patent: Feb. 11, 1992

[54] PIPE SEVERING METHOD AND APPARATUS

[75] Inventors: James A. Angel, Antioch; Gilbert G. Hagar, Brentwood; Michael H. Clement, Antioch, all of Calif.

[73] Assignee: Kwik Snap Corporation, Pittsburgh, Calif.

[21] Appl. No.: 607,121

[22] Filed: Oct. 31, 1990

[51] Int. Cl.[5] ..... B26F 3/00

[52] U.S. Cl. ..... 225/1; 30/100; 30/101; 83/374; 225/104; 225/105

[58] Field of Search ..... 225/1, 103, 104, 105; 30/100, 101; 83/374, 380

[56] References Cited

U.S. PATENT DOCUMENTS

| | | | |
|---|---|---|---|
| 2,862,295 | 12/1958 | Harding et al. | 30/92 |
| 2,949,669 | 8/1960 | Wheeler | 30/92 |
| 3,157,945 | 11/1964 | Picking | 30/101 |
| 3,244,339 | 4/1966 | Carner | 225/104 |
| 3,341,098 | 9/1967 | Singley | 225/104 |
| 3,351,252 | 11/1967 | Singley et al. | 225/103 |
| 3,763,559 | 10/1973 | Axbjer | 30/100 |
| 3,862,710 | 1/1975 | Bivona et al. | 225/103 |
| 4,370,995 | 2/1983 | Smith | 137/15 |
| 4,535,924 | 8/1985 | Quinn | 225/104 |
| 4,663,844 | 5/1987 | Vegge | 30/100 |

FOREIGN PATENT DOCUMENTS 602289 7/1978 Fed. Rep. of Germany .

*Primary Examiner*—Hien H. Phan

*Attorney, Agent, or Firm*—Townsend and Townsend

[57] ABSTRACT

A pipe severing device (1) and method utilizing a chain (13) having stress inducing wheels (19) efficiently and safely severs brittle materials including cast iron, vitreous clay, cement and asbestos pipe. The device includes an actuating handle (6) which pivots over a pipe support surface (3). Upon pivoting over the surface, hold-down arms (7) attached to the actuating handle frictionally grasp a pipe. The handle may then pivot about a second point or remain rigid, in either case engaging a first limit switch (25) which actuates a hydraulic cylinder (35). The hydraulic cylinder tightens the chain causing the stress inducing wheels to create stress concentration points around the circumference of the pipe. Cracks propagate between stress concentration points, quickly severing the pipe. The pipe support surface includes resilient pads (5a,b) which further frictionally grasp the pipe.

17 Claims, 7 Drawing Sheets

PIPE SEVERING METHOD AND APPARATUS

BACKGROUND OF THE INVENTION

This invention relates generally to pipe severing apparatus and methods, and specifically to a method and apparatus for severing cast iron and other brittle pipe in a fast, safe manner, in a variety of sizes, and at various locations around a job site.

Previously, brittle pipe such as cast iron has been "cut" by a variety of methods. Most of these methods include the use of a chain having cutting wheels wrapped around the pipe and reciprocated by manual or mechanical means. However, it is well known that brittle materials, such as cast iron, vitreous clay, cement, and asbestos can actually be severed rather than cut, so that use of the reciprocating chain devices is no longer economical as it is a slower process.

Rather than using the reciprocating chain and cutting wheels procedure, it is known to hold the chain and cutting wheels in primarily fixed position while tensioning the chain. In this mode, the wheels are actually "stress inducing" wheels, and several wheels "dig" into the circumference of the brittle pipe, creating stress concentration points and initiating cracks that propagate from stress concentration to stress concentration, leading to catastrophic failure around the entire circumference.

Although advantageous, the unique property of these brittle materials to easily sever under stress can cause severe safety concerns where pipe severing is performed on a large scale, such as at residential and commercial construction sites, where cast iron, vitreous clay, cement, asbestos, and other brittle pipe materials are commonly used for plumbing and other end uses, due to their availability, ease of severing, and economic advantage. It would be advantageous if a pipe severing method and apparatus could be devised that would quickly and safely sever the pipe, preventing the two pieces from flying apart like projectiles. Further, many pipe severing devices currently used have configurations which allow the operator to easily have either one or both hands come close to the cutting chain. Some of these devices have foot pedals which actuate the chain, leaving the operator's hands substantially free, a potentially hazardous situation. Also, many of these devices are either fixed to the pipe to be severed, or are otherwise practically immobile so as to render them cumbersome at a residential or commercial construction site, where it would be convenient and advantageous to have a mobile device configuration. Still more advantageous would be a pipe severing device of the chain type which had simple means of keeping the chain substantially circular about the circumference of the pipe, so that many successive pieces of the same diameter could be quickly severed.

SUMMARY OF THE INVENTION

To avoid the safety hazards heretofore encountered, and to provide a mobile and fast method of severing cast iron, vitreous clay, cement, asbestos, and other brittle material pipe, there is described and claimed herein a new and useful pipe severing apparatus and method. The apparatus includes a frame having a substantially horizontal pipe support surface for supporting a pipe. A pipe severing chain assembly carried by the frame includes a chain, a chain cleat which grasps one end of the chain, and a chain drive actuated by a chain drive actuator. The chain has a plurality of stress inducing wheels mounted on a plurality of links, the links having laterally protruding pins. The chain drive includes a power unit, actuated by the chain drive actuator pivotally extending over the support surface. The chain drive actuator has connected thereto at least one holddown member, preferably aluminum, positioned to frictionally engage the pipe on both sides of the chain when the chain drive actuator is pivoted over the support surface, so that when the chain is drawn tight around the pipe by a power unit operated cam, the stress inducing wheels induce stress concentration points around the pipe, quickly severing the pipe.

In severing a brittle pipe, the following sequence is executed: the pipe is placed on the substantially horizontal support surface of the frame. The chain assembly having a chain with a plurality of stress inducing wheels and a plurality of links having laterally protruding pins is wrapped around the circumference of the pipe, the chain having retaining springs to bias the chain in a substantially circular position around the pipe, allowing easy insertion of the next piece to be severed. One end of the chain is connected to the hydraulically operated cam and at least one link of the chain is connected to a chain cleat, thereby wrapping the pipe with the chain, with stress inducing wheels touching the pipe at some locations. The actuating handle or arm is then pivoted about a first pivot point until the holddown members attached to the actuating handle just touch the pipe to be snapped. A limit switch in the actuating handle is contacted, thereby causing the chain to tighten around the pipe inducing stress concentration points around the circumference of the pipe at selected locations.

In a second embodiment, part of the actuating handle pivots about a second point after the holddown members have contacted the pipe. Actuating handle ends force push rods within spring tubes to contact the limit switch. This allows a substantially consistent downforce to be applied, useful for when various pipe diameters or pipe of the same diameter is to severed.

Further improvements, advantages, embodiments and aspects of the invention will become apparent from the description which follows.

DESCRIPTION OF SPECIFIC EMBODIMENTS

Figure 1:
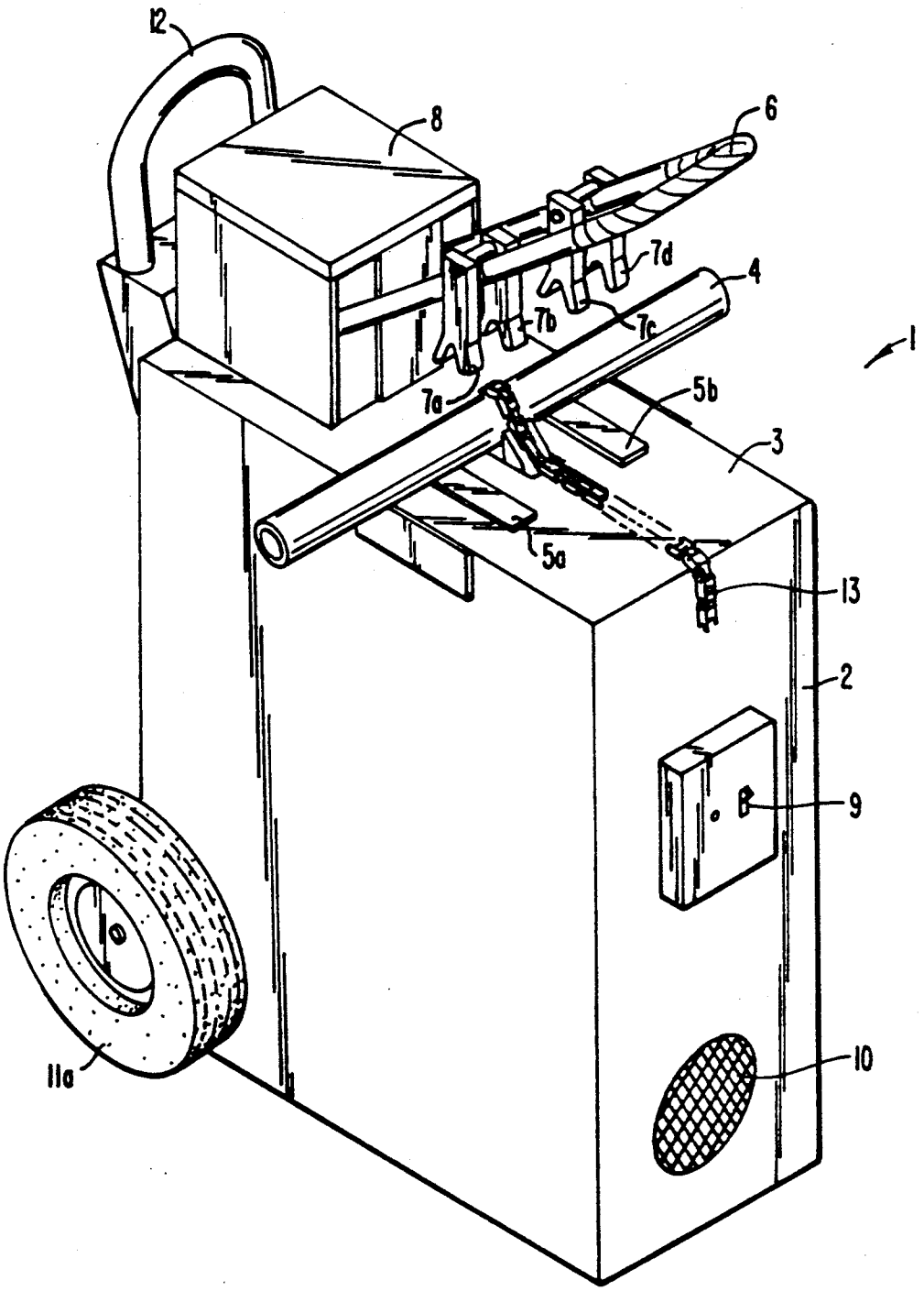
FIG. 1 is a perspective view of the pipe severing device presented as one illustrative embodiment of the present invention.

The view presented in FIG. 1 shows many of the pipe severer components in assembled form. Of course, when the term "pipe" is used herein, it is understood to be a generic term used to describe relatively brittle, round hollow articles. The assembled pipe severing device 1 includes a frame 2 having a generally horizontal pipe support surface 3. A pipe to be severed 4 rests upon resilient pads 5*a,b* attached to the surface 3. Actuating handle 6 has four holddown members 7*a,b,c,d* which frictionally engage the pipe when handle 6 is pivoted down toward the pipe, to be more fully described, infra.

Figure 5:
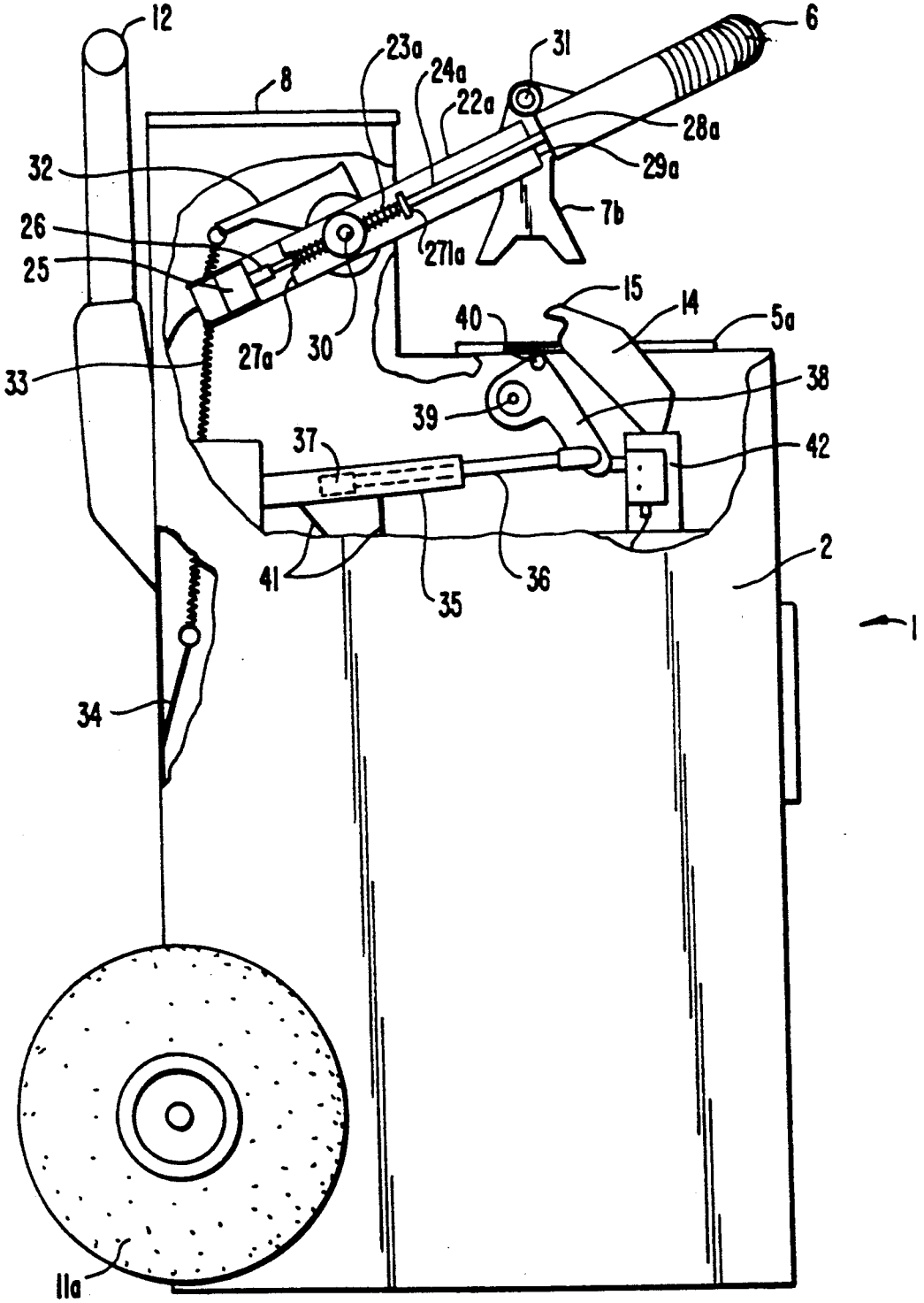
FIG. 5 is a side elevation and sectioned view of the pipe severing device of FIGS. 2–4.
Figure 6:
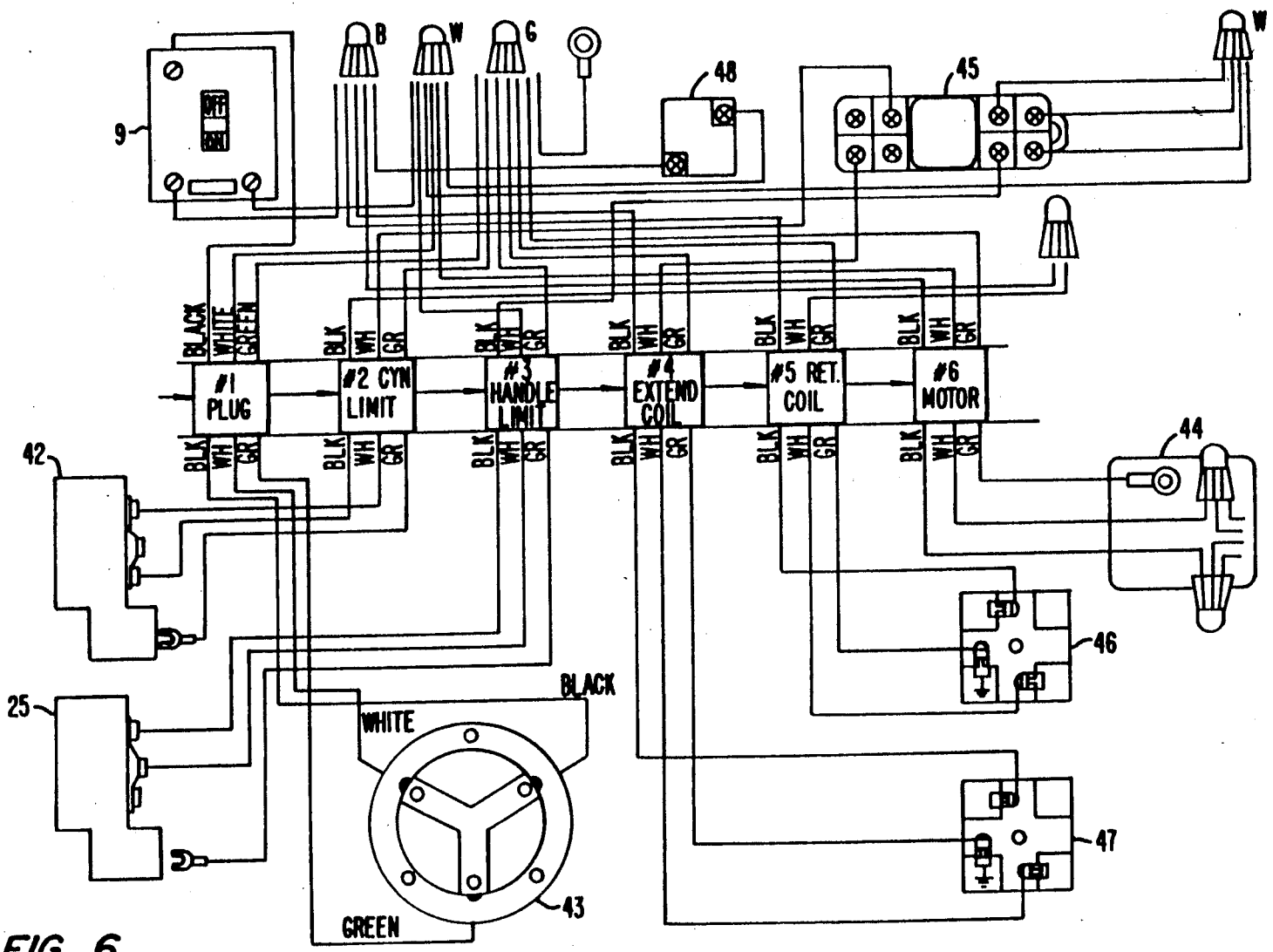
FIG. 6 shows a schematic drawing of the hydraulic and electric controls of the embodiments shown in FIGS. 1–5.

Pipe severing device 1 further has a housing 8, which houses one pivot point for this embodiment. Electric power switch/heater 9 energizes a motor within frame 2, while air vent 10 functions to cool the motor and provide necessary air for the hydraulic system within frame 2. (FIG. 6 shows a schematic of the electric and hydraulic controls.) The device has wheel and axle assemblies 11*a,b* (only 11*a* shown) and transporting handle 12, allowing easy transport. Wheels 11*a,b* preferably do not support frame 2, but are positioned on the frame so that only when the device is pivoted backward about the bottom rear corners of the device do the wheels function to support the device for transporting it to another location. (See FIGS. 2, 3, and 5.) A chain 13 having stress inducing wheels is shown wrapped about a pipe to be severed. More detailed views of the chain are showed in FIGS. 4 and 9. It will be appreciated that the term "wheels" is to be interpreted broadly to include square, rectangular or semi-round members.

Figure 2:
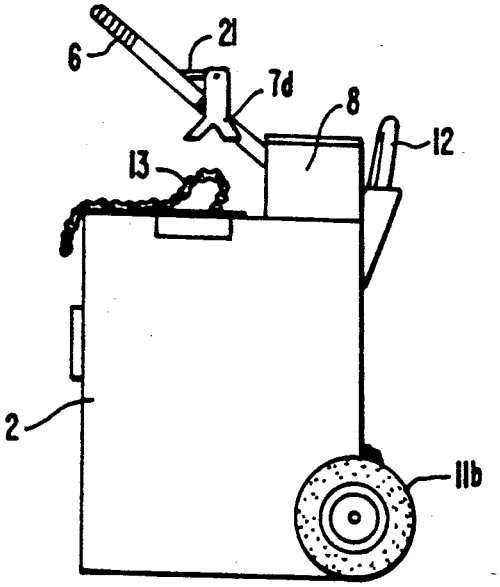
FIG. 2 is a side elevation of the embodiment shown in FIG. 1, including a protective guard.
Figure 3:
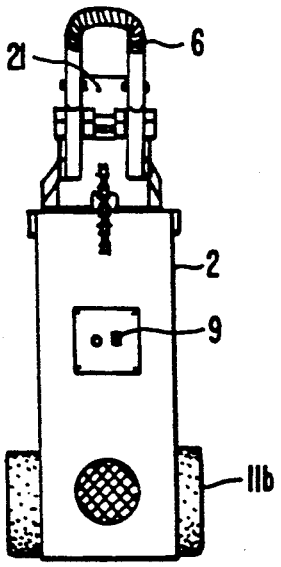
FIG. 3 is a front view of the embodiment shown in FIG. 2.

FIGS. 2 and 3 show side and front views, respectively, of the pipe severing apparatus of FIG. 1 including a protective guard 21. In this embodiment, actuating handle 6 is shown in the position when the apparatus is in a neutral mode. Holddown member 7*d* is shown attached to handle 6. FIGS. 2 and 3 emphasize the fact that the pipe severing apparatus is quite mobile and easily moved from one location to another location such as at a residential or commercial job site.

Figure 4:
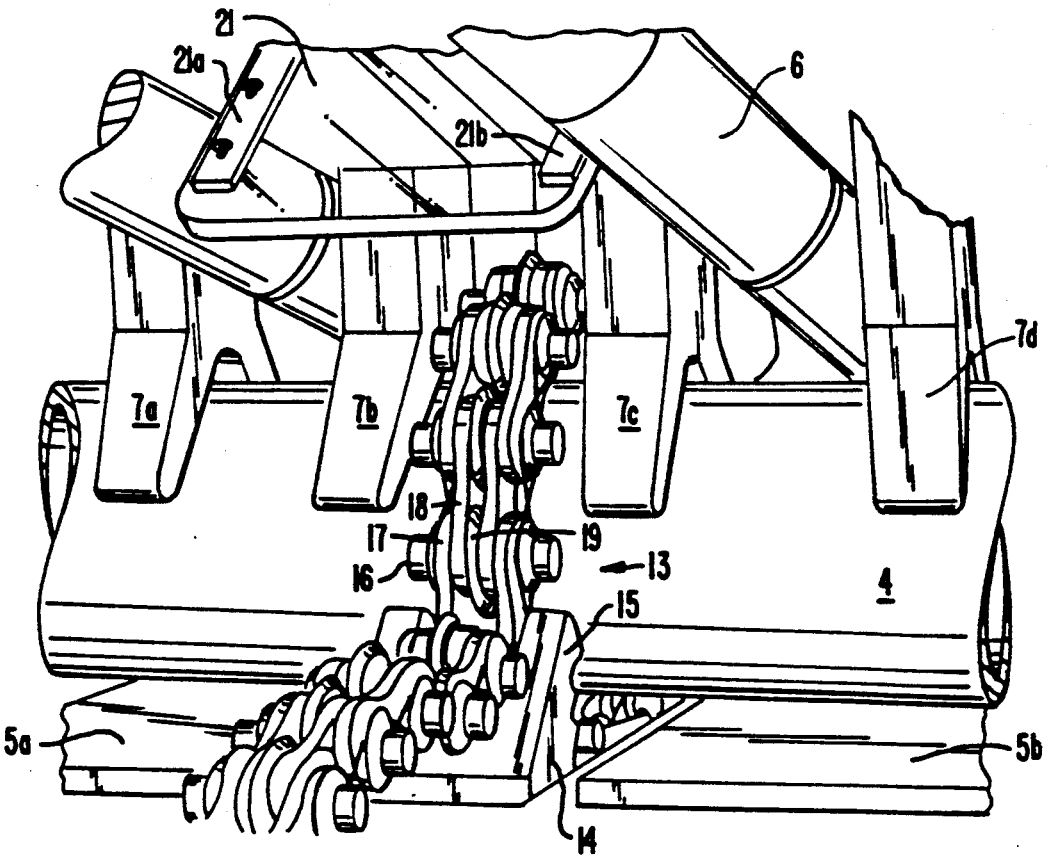
FIG. 4 is a perspective view of a chain having stress inducing wheels wrapped around a pipe to be severed.

FIG. 4 shows a view of a pipe 4 to be severed, showing chain 13. Chain cleat 14 has tongues 15 which grasp chain pins 16, which laterally protrude from chain 13. (See also FIG. 5.) Chain 13 has outer links 17 and inner links 18, through which pins 16 extend. Stress inducing wheels 19 are positioned at various locations on the pipe to be severed. Note that holddown members 7*a,b,c,d* are positioned on to firmly grasp the top portions of the pipe to be severed, and on both sides of chain 13. This positioning, along with resilient pads 5*a,b* create friction surfaces and keep the pipe from moving axially, rotationally, vertically or horizontally during and shortly after the severing operation, a significant safety feature.

The embodiments shown in FIGS. 1 through 4 show four holddown members 7*a,b,c,d* removably attached to actuating handle 6, although either more or less holddown members could perform the function of holding two pieces of pipe after being severed. This is an extremely important safety feature of the present invention. Also note that actuating handle 6 (FIG. 4) holds protective guard 21, which comes between the operator's face and the pipe to be severed when handle 6 is brought into position to sever the pipe. Guard 21 is preferably clear to permit the operator a clear view of chain 13 engaging pipe 4. Protective guard 21 is usually a polycarbonate, other impact and shatter resistant materials being known. Protective guard 21 is typically removably attached to actuating handle 6 using welded clips 21*a* and 21*b* on both the left and right sides of guard 21. Rivets or screws may also be used. The combination of the holddown members with the protective guard makes for very safe and worry-free operation of the device. This combination, along with the operation of the limit switches to be described below, make for a very fast and safe method of severing brittle pipe.

Referring now to FIGS. 5 and 7*a–c*, FIG. 5 shows a side elevation, partially sectional view of one embodiment of the apparatus, with some components deleted for clarity. Pipe severer 1 has actuating handle 6 and spring tubes 22*a,b* (left-hand "b" parts not shown), which are separate pieces from actuating handle 6 in this preferred embodiment. Inside of spring tubes 22*a,b*, and coaxially therein lie actuating handle springs 23*a,b*, push rods 24*a,b*, and handle limit switch assembly 25, which may be located in either of the spring tubes 22*a* or 22*b*. All that is required is that handle limit switch assembly 25 be located so that when one of the push rods 24*a* or 24*b* is moved toward the end of spring tubes 22*a,b*, the limit switch is activated and thereby causes the severing of the pipe, as further described with reference to FIGS. 7 and 8. Handle limit switch assembly 25 is fastened inside either of spring tubes 22*a* or 22*b* via fasteners, for example, simple bolt and nut arrangements. Guide cap 27*a* allows push rod 24*a* to contact limit switch 25 at contact point 26 when actuating handle 6 is pivoted into position to sever a pipe. Actuating handle springs 23*a,b* are compressed between guide cap 27*a* and collar 271*a*. Push rods 24*a,b* have distal ends generally near guide cap 27*a,b* and proximal ends near push rod caps 28*a,b*, which are inserted into the ends of actuating handle 6. Chain 13 (not shown) is tightened by action of a hydraulic cylinder 35 having piston rod 36 and piston 37, which is movably attached to a cam 38. Cam 38 rotates about a cam hub 39 fixed to frame 2. Chain 13 (not shown) attaches to chain pin 40 on cam 38. Cylinder limit switch assembly 42, when activated by cam 38 as shown, puts the pipe severer in a neutral mode. The "neutral" and "active" modes of operation are described in more detail infra. Cylinder limit switch assembly 42 is electrically connected to an electrical box (not shown). Further wiring connects the electrical box to a hydraulic power unit and solenoid valves. (See schematic of the electric and hydraulic controls in FIG. 6.) Thus, when actuating handle 6 is pivoted over a pipe (FIGS. 7*a–c*), pivoting about first pivot bolt 30, handle limit switch assembly 25 activates the hydraulic power unit so that hydraulic oil in a reservoir is forced into hydraulic cylinder 35. This causes cam 38 to rotate about cam hub 39 causing chain 13 (FIG. 4) to tighten about pipe 4.

In the embodiments shown in FIGS. 1–5 and 7*a–c*, actuating handle 6 pivots about pivot bolt 30 before holddown members 7*a,b,c,d* have contacted the pipe to be severed. At this point, and only at this point, further pivoting about pivot bolt 31 will force push rod caps 28*a,b* against proximal ends of push rods 24*a,b* and move the push rods toward contact point 26 of handle limit switch assembly 25. This second pivot point on the actuating handle has the advantage of making it possible for the same amount of force to be applied to different pipe diameters. Preferably, the pipe severer can sever pipe diameters in the range of from about 1 to about 6 inches. This second pivot point is not necessary for safe operation of the device, but affords an improved performance over an actuating handle which merely pivots about a first pivot point 30, each embodiment being considered within the scope of the invention.

The combination of limit switch assemblies 25 and 42, spring biased actuating handle 6, holddowns 7 and pads 5, and guard 21 create a very safe and efficient mode of severing pipe. As actuating handle 6 is brought into position to sever a pipe, protective guard 21 is moved between the cutting chain and the operator's face. Further, since a foot pedal is not needed to operate the apparatus, and since the actuating handle springs 23*a,b* require sufficient force to compress, both hands are generally required to operate the device, thereby eliminating the possibility that a hand or finger could become entangled in the chain. Further to these ends, a return spring bracket 32 and return spring 33 resist movement of actuating handle 2 down towards the pipe to be cut. (See FIG. 5) Return spring 33 is connected to spring anchor 34 inside of frame 2, where spring anchor 34 is welded or otherwise attached to frame 2. After the pipe has been severed, actuating handle springs 23*a,b* force actuating handle 6 back into a non-knuckled position, and return spring 33 rotates the entire actuating handle 6 and spring tubes 22*a,b* back into neutral position by rotating around first pivot bolt 30.

Cylinder limit switch assembly 42 is attached via an adapter plate and bolt assembly to the inside of frame 2, and is electrically connected via wires to previously mentioned electrical box, said connections being well known in the art. Hydraulic cylinder 35 is attached to frame 2 via welding or other suitable methods.

Electrical and hydraulic controls are shown schematically in FIG. 6. The machine can be configured to run either with 110-volt power at 11.2 amps or 230 volts at 5.6 amps, whichever power level is available at the job site. Plug 43 is the only external connection needed to operate the machine. Operation of switch/heater 9 immediately places the machine in the neutral mode by starting motor 44, with cylinder limit switch 42 activated and handle limit switch 25 deactivated. Relay 45 receives signals from limit switches 25 and 42, alternately energizing solenoids 46 and 47. When in the neutral mode, solenoid 46 is deenergized and solenoid 47 is energized, allowing recirculation of hydraulic oil through a reservoir (not shown). When the machine is in the active mode solenoid 47 is deenergized and solenoid 46 is energized, allowing hydraulic fluid to travel to cylinder 35 to actuate cam 38 and tighten the chain. Light bulb 48 indicates an active mode for the machine.

The reservoir capacity and fluid types are not critical; however, a typical reservoir capacity is about three quarts, with any non-foaming hydraulic oil being suitable. Preferably, 10-weight non-foaming hydraulic oil is used. The hydraulic reservoir has a fill and vent attachment positioned so that upon normal use, and tilting of the device rearward when moving it, the oil does not drain out.

One requirement for a pipe severing apparatus is that it be easily moved from job site to job site. To this end, the pipe severer is provided with wheel and axle assemblies 11*a,b* (FIGS. 1–3, 5), attached to frame 2 via known methods. As stated supra the wheels serve to transport the device, not to support it during operation, the stability being greater when the bottom of frame 2 is the supporting structure.

In the embodiments shown in FIGS. 1 through 5 and FIG. 9, spring tubes 22*a,b*, return spring bracket 32 and return spring 33 are partially contained within housing 8, this being generally for cosmetic purposes, it being recognized that other housing configurations may be used or no housing at all, provided first pivot bolt 30 is adeqately supported.

The pipe severer of the present invention has generally horizontal resilient surfaces 5*a,b* on which a pipe is laid. As used herein, the term "resilient" refers to both solid resilient pieces and pieces comprised of, for example, steel, coated with such surfaces. What is generally required is that holddown members 7*a,b,c,d* and surfaces 5*a,b* frictionally grasp the pipe before and after it has been cut to prevent the separate pieces from becoming dangerous projectiles. Resilient surfaces 5*a,b* can be made of synthetic or natural resilient material. Examples of resilient materials that may be used include polyisoprene (natural rubber), polybutadiene, neoprene, other halogenated rubbers, and urethanes. Holddown members 7*a,b,c,d* are generally one-piece metallic structures, preferably aluminum, although they may be comprised of two or more pieces welded, bonded, bolted, etc. together. The holddown members may also be synthetic or natural resilient materials, although metal is preferred, particularly aluminum.

Figure 7A:
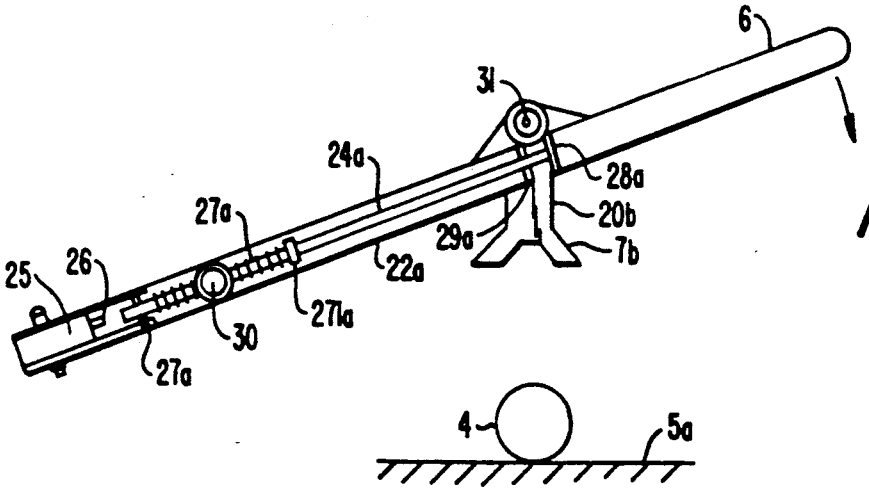
FIGS. 7(*a*)–(*c*) are side sectional views showing the operation of the actuating handle and two pivot points of the handle when a pipe is desired to be severed according to one embodiment of the device.
Figure 7B:
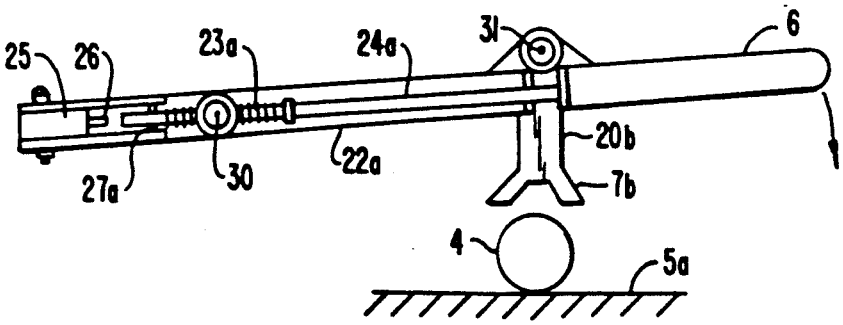
Figure 7C:
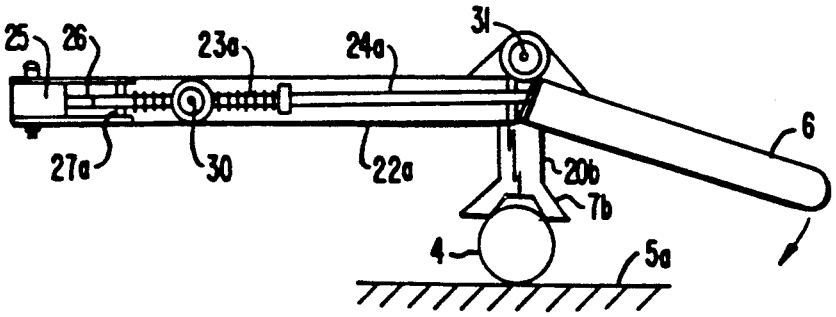

FIGS. 7(*a*) through (*c*) further define how the actuating handle 6 pivots about two locations in actuating the chain for one preferred embodiment. In this procedure for severing a pipe, the pipe severer is initially in a "neutral mode." This is shown in FIG. 5 and 7*a*, with the actuating handle 6 and spring tubes 22*a,b* being in the same position in FIGS. 5 and 7*a*. In the "neutral mode," the solenoids 48 (FIG. 6) allow hydraulic oil to recirculate through a pump and reservoir system contained in frame 2. Motor 48 is run at all times, both in "neutral" and "active" modes. Switch/heater 9 acts as a circuit breaker, in the event motor 48 overloads. As the actuating handle 6 is pivoted about pivot bolt 30, and as holddown members 7*a,b,c,d* approach pipe 4 as shown in FIG. 7(*b*), actuating handle springs 23*a,b* remain in an uncompressed state. It is only when hold-down members 7*a,b,c,d* engage pipe 4 that actuating handle 6 further pivots about pivot bolt 30, as shown in FIG. 7*c*. As actuating handle 6 pivots about pivot bolt 30, push rods 24*a,b* is forced down to touch contact 26 of handle limit switch 25. Thus, as actuating handle 6 is lowered, push rods 24*a,b* move through ring caps 29*a,b* and guide caps 27*a,b* while actuating handle springs 23*a,b* are compressed. Spring tubes 22*a,b* pivot about pivot bolt 30, allowing actuating handle 6 to approach a pipe to be severed. Handle limit switch 25 then actuates hydraulic cylinder 35 and chain 13. The pipe severer shown in FIG. 7(*c*) is in an "active mode".

Figure 8A:
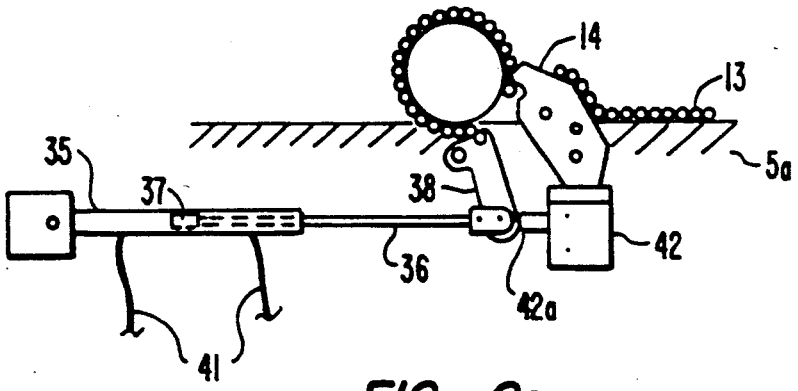
FIGS. 8(*a*) and (*b*) are side section views of a chain tightening means acting in correspondence with the actuating handle of FIG. 7(*a*)–(*c*)
Figure 8B:
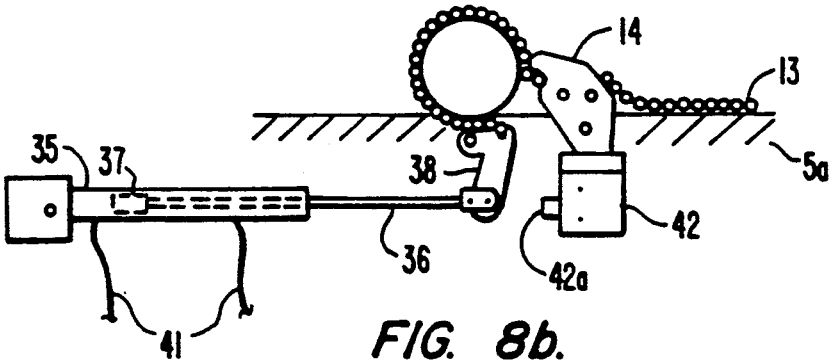

FIG. 8*a* corresponds to the position of piston 37 during the sequences shown in FIGS. 7*a* and 7*b*. FIG. 8*b* shows the movement of piston 37, to the left in this embodiment through hydraulic cylinder 35, piston 37 being moved by the addition of hydraulic fluid through a hydraulic hose 41. Hydraulic fluid moves out of hydraulic cylinder 35 through another hydraulic hose as shown in FIG. 8*b*. It will be recognized that the relative movement of piston 35 and the movement of the hydraulic oil through the hydraulic hoses 41 may be reversed and still accomplish the same function through suitable drive mechanisms. Cylinder limit switch assembly 42 is shown disengaged from cam 38, thereby allowing the pipe severer to transfer from a neutral mode to an active mode.

Figure 9:
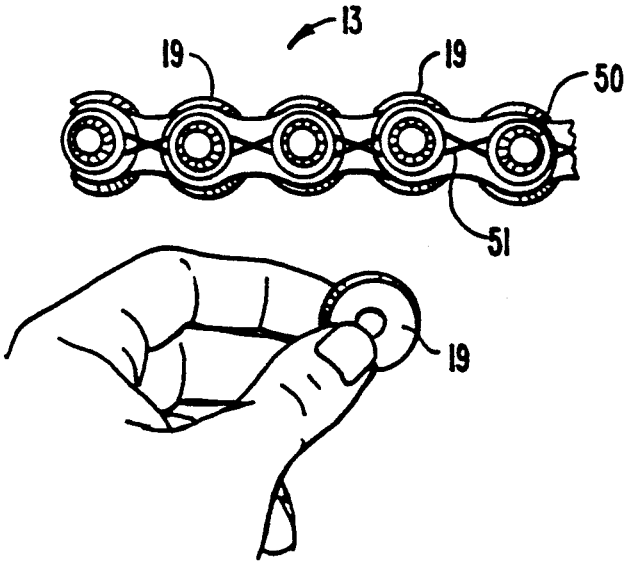
FIG. 9 is a side view of a chain in accordance with the present invention showing spring retainers and keepers.

FIG. 9 shows a detail of stress inducing wheels 19, pin retaining springs 51, and retaining spring keepers 50. Quick and easy indexing of proper chain pin (16, FIG. 4) to be used when severing each size of pipe is accomplished by color coded retaining spring keepers 50 installed at predetermined positions about the chain. These color coded keepers are factory installed for 1½, 2, 3, and 4 inch No Hub ® cast iron pipe, but may be easily repositioned by the operator for other pipe sizes. Shown at 19 is a stress inducing wheel having chipped edges, which may be due to excessive wear and may lead to inability of wheels to spin or rotate on the chain pins. Chain life can be extended somewhat by "reversing" the chain when only small (1½ and 2 inch) pipe is being severed, as most wear will occur on wheels nearest where the chain attaches to the hydraulic cleat 14 as shown in FIGS. 8*a* and 8*b*. However, when larger diameters are being severed, the length of the chain is usually such that nearly all of the wheels are used, so that uniform wheel wear is anticipated, the force exerted by each wheel being approximately the same.

Figure 10:
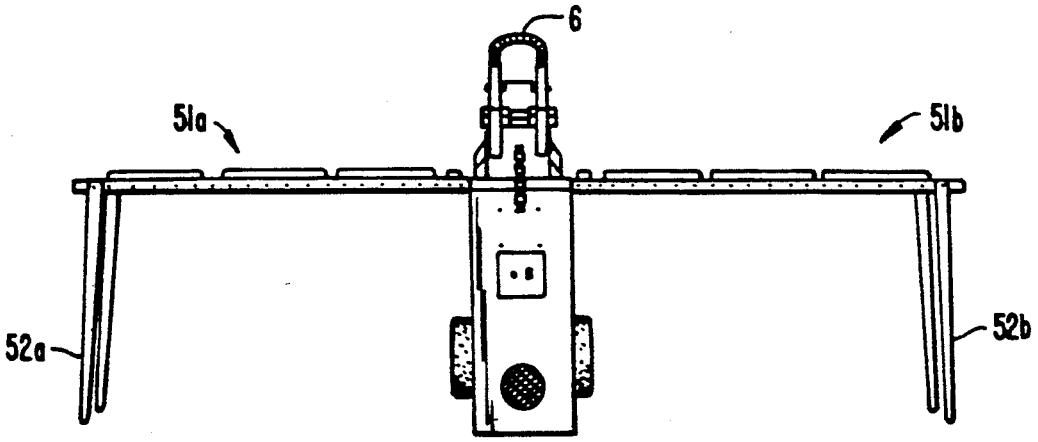
FIG. 10 is a front elevation showing portable table attachments.
Figure 11A:
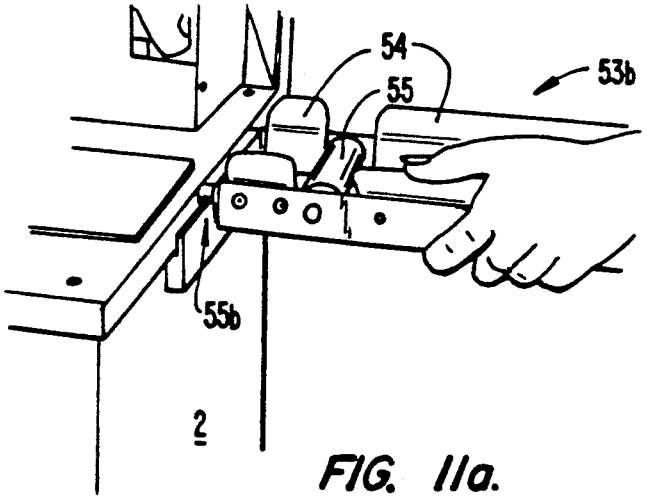
FIGS. 11(*a*) and (*b*) are perspective views of the portable tables of FIG. 10.
Figure 11B:
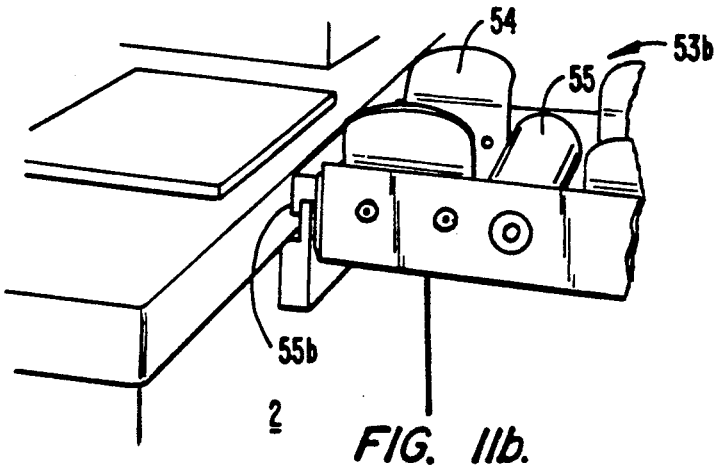

FIGS. 10 and 11 show additional accessories for the pipe severer of the present invention. Fold-out tables 51*a,b* have drop legs 52*a,b*. Tables 51*a,b* easily attach to frame 2 via clips 55*a,b*. Rollers 55 allow pipe to be severed to easily reach the chain mechanism, while pipe guides 53 guide the pipe to be severed in a straight manner. Tables 51*a,b* may easily be folded and stored.

In operating the pipe severer of the present invention, the method of severing cast iron, vitreous clay, cement, asbestos, or other brittle pipe comprises placing a pipe made of such material on a surface of mobile frame 2, and arranging chain 13 around the circumference of the pipe, the retaining springs 51 biasing the chain in a substantially circular position around the pipe. With the actuating handle 6 in a fully upright position, the chain is wrapped around the pipe and secured by chain cleat 14 as tightly as possible, with wheels 19 touching the pipe at selected locations about the pipe circumference. At least one, preferably two or more appropriately sized holddown members 7 are removably attached to actuating handle 6 so that both sections of pipe on either side of chain 13 are held when actuating handle 6 is depressed. Actuating handle 6 is then pivoted about first pivot point 30 until holddown members 7 touch the pipe. Continued downward movement of handle 6 causes handle 6 to pivot about second pivot point 31 to actuate handle limit switch 25, which in turn actuates a hydraulic power unit. Oil is forced into hydraulic cylinder 35, causing rotation of cam 38 and severing of the pipe. The forward stroke of piston rod 36 is halted when cylinder limit switch 42 is actuated. To complete a cycle, the severer is returned to "neutral" mode when the operator releases handle 6 to permit springs 23*a,b* and 33 to return handle 6 from the position of FIG. 7*c* to the position of FIG. 7*a* to deactivate limit switches 25 and 42.

The pipe is severed almost instantaneously upon the chain being tensioned. The pipe is not cut but rather severed by inducing stress concentration points around the circumference of the pipe at selected locations. By virtue of pin retaining springs 51, the chain generally tends to remain in position in the chain cleat and so to be ready for subsequent cuts of the same sized pipe.

The foregoing description is offered primarily for purposes of illustration. It will be readily apparent to those skilled in the art that further modifications, variations and the like may be introduced in the materials, configurations, arrangement and shapes of the various elements of the structure without departing from the spirit and scope of the invention. For example transport wheels 11*a,b* could provide support only when the machine is pivoted backward, allowing the machine to be laid on its back with the weight carried by the handle 12 and wheels 11*a,b*. In order that this may be done without the loss of hydraulic fluid, the orientation of the fill and vent cap may be arranged so that this point remains above the fluid level in the reservoir whether the machine is in the upright position or laid back against handle and wheels.

What is claimed is:

1. A method of safely and quickly severing brittle pipe materials including cast iron, vitreous clay, cement, and asbestos comprising:

placing a pipe on a substantially horizontal surface of a mobile frame;

arranging a chain around the circumference of said pipe, said chain having a plurality of stress inducing wheels and a plurality of links having laterally protruding pins, said chain further having retaining spring means to bias said chain in a substantially circular position around said pipe;

connecting one end link of said chain to a cam actuated by a power unit and at least one other link of said chain to a chain cleat thereby tightly wrapping said pipe with said chain, said wheels touching said pipe at preselected locations;

pivoting an actuating handle about a pivot point, said handle having first and second holddown members attached thereto and positioned to frictionally engage the pipe on both sides of said chain, said actuating handle having a limit switch so that when said holddown members come into contact with the pipe to be severed, said limit switch actuates said hydraulic power unit, causing said chain to tighten about the pipe and induce stress concentration points around the circumference of said pipe at said selected locations and sever the pipe.

2. A method in accordance with claim 1 wherein said support surface further having resilient pads thereon on both sides of said chain for frictionally engaging the pipe to be severed.

3. A method in accordance with claim 2 wherein said holddown members are metallic and said resilient pads are made from materials including polyisoprene, polybutadiene, neoprene, fluorinated and chlorinated rubbers, and urethanes.

4. A method in accordance with claim 3 wherein said actuating handle further having ends pivotally connected to first and second spring tubes thereby forming a second pivot point for the actuating handle, said spring tubes having first and second actuating handle springs coaxial within said respective first and second spring tubes, first and second push rods movable coaxially within said respective spring tubes and said respective handle springs, said push rods having each a distal end and a proximal end, at least one of said push rod distal ends adapted to engage said first limit switch when said chain drive actuator is pivoted over said pipe support surface.

5. A method in accordance with claim 4 wherein a protective guard is fixedly attached to said actuating handle such that when said actuating handle is pivoted over said support surface and into a position to sever the pipe, said protective guard is between the operator's face and the section of pipe engaged by said chain.

6. A mobile pipe severing apparatus comprising:

a frame having a substantially horizontal pipe support surface;

pipe severing chain assembly carried by said frame including a chain, a chain cleat which grasps one end of said chain, and a chain drive actuated by a chain drive actuator, said chain having a plurality of stress inducing wheels mounted on a plurality of links, said links having laterally protruding pins, said chain drive including a power unit, said chain drive actuator comprising means for pivotally extending over said support surface in a manner allowing said actuator to actuate said chain drive; and a pipe stabilizing assembly attached to said chain drive actuator including at least one holddown member positioned to frictionally engage the pipe on both sides of said chain when said chain drive actuator is pivoted over said support surface, so that when said chain is drawn tight around the pipe said stress inducing wheels induce stress concentration points around the pipe and quickly sever the pipe.

7. Apparatus in accordance with claim 6 wherein:

said pipe comprises brittle materials including cast iron, vitreous clay, cement, and asbestos; and said chain drive actuator further comprises a tubular actuating handle having ends adapted to engage a first limit switch for actuating said power unit when said chain drive actuator is pivoted over said pipe support surface.

8. Apparatus in accordance with claim 7 wherein said power unit includes a hydraulic cylinder, and said frame includes a cam having a chain pin, said cam movably connected to a piston rod of said hydraulic cylinder, said cam rotating about a cam hub attached to said frame when said power unit is actuated by said first limit switch.

9. Apparatus in accordance with claim 8 said chain cleat having tongues which grasp said laterally protruding pins on said chain when said cam is rotated about said cam hub, thereby drawing said chain tight around the pipe, allowing said wheels to induce said stress concentration points.

10. Apparatus in accordance with claim 8, said power unit further having a second limit switch actuated by said cam when said apparatus is in a neutral mode, said second limit switch when activated halting forward motion of said piston rod and allowing a pump to recirculate hydraulic fluid in a reservoir in said power unit.

11. Apparatus in accordance with claim 10 wherein said first and second limit switches actuate first and second solenoid valves, thereby allowing operation of said apparatus alternately in a neutral mode and an active mode.

12. Apparatus in accordance with claim 7 having a plurality of transporting wheels and a further handle by which said apparatus may be moved from job site to job site.

13. Apparatus in accordance with claim 7 having a protective guard fixedly attached to said actuating handle such that when said actuating handle is pivoted over said support surface and into a position to sever the pipe, said protective guard is between the operator's face and the section of pipe engaged by said chain.

14. Apparatus in accordance with claim 13 wherein said tubular actuating handle having ends pivotally connected to first and second spring tubes thereby forming a second pivot point for the actuating handle, said spring tubes having first and second actuating handle springs coaxial within said respective first and second spring tubes,, first and second push rods movable coaxially within said respective spring tubes and said respective handle springs, said push rods having each a distal end and a proximal end and allowing said handle ends to force at least one of said push rod distal ends against said first limit switch and actuate said chain drive.

15. Apparatus in accordance with claim 6 further having resilient pads on said support surface on both sides of said chain which engage and frictionally hold said pipe both before and after severing said pipe.

16. Apparatus in accordance with claim 15 wherein said at least one holddown member is metallic and said resilient pads are made from materials including polyisoprene, polybutadiene, neoprene, fluorinated and chlorinated rubbers, and urethanes.

17. Apparatus in accordance with claim 6 wherein said chain has pin retaining springs which bias said chain in a substantially circular position around the pipe.

* * * * *